United States Patent [19]

Rockerath et al.

[11] 4,111,138

[45] Sep. 5, 1978

[54] SEWING MACHINE MATERIAL PREASSEMBLY SYSTEM

[75] Inventors: John L. Rockerath; Harold J. Schreck, both of Utica, N.Y.

[73] Assignee: Cluett, Peabody & Co. Inc., Troy, N.Y.

[21] Appl. No.: 738,746

[22] Filed: Nov. 3, 1976

Related U.S. Application Data

[62] Division of Ser. No. 619,968, Oct. 6, 1975, Pat. No. 4,009,672.

[51] Int. Cl.[2] ..... D05B 35/02; D05B 27/00

[52] U.S. Cl. ..... 112/141; 112/203

[58] Field of Search ..... 112/141, 142, 143, 152, 112/147, 136, 203

[56] References Cited

U.S. PATENT DOCUMENTS

| | | | |
|---|---|---|---|
| 192,766 | 7/1877 | Jonasson | 112/141 X |
| 790,560 | 5/1905 | DeNike | 112/152 X |
| 998,956 | 7/1911 | Coghill | 112/152 X |
| 1,201,423 | 10/1916 | Almond | 112/152 |
| 1,831,592 | 11/1931 | Friedman | 112/152 X |
| 2,149,755 | 3/1939 | Ackerman | 112/147 |
| 3,884,166 | 5/1975 | Rinehimer et al. | 112/141 X |

*Primary Examiner*—H. Hampton Hunter

*Attorney, Agent, or Firm*—Prutzman, Hayes, Kalb & Chilton

[57] ABSTRACT

A sewing machine installation for sewing shirt front box hems and having a first underlying belt conveyor for individually conveying shirt front material blanks longitudinally forwardly along a lower main support table through a shirt front edge folder and a second overlying belt conveyor for individually conveying separate box hem material blanks with a liner tape longitudinally forwardly along an upper auxiliary table section through a box hem edge folder and into superimposed preassembled association with the prefolded shirt front blanks; the overlying and underlying conveyors thereafter cooperating for conveying the preassembled shirt front box hems longitudinally forwardly along the main support table through sewing and shearing stations for sewing the preassembled shirt front box hems and shearing excess material from the leading and trailing edges thereof. In an alternative operational configuration of the sewing machine installation, the upper auxiliary table section is inoperative and an entry section of the overlying belt conveyor is lowered into cooperative engagement with the underlying belt conveyor for conveying shirt front blanks along the main support table through a box front hem folder for prefolding a single piece shirt box front hem.

6 Claims, 8 Drawing Figures

SEWING MACHINE MATERIAL PREASSEMBLY SYSTEM

This application is a divisional application of applicants' copending application Ser. No. 619,968, filed Oct. 6, 1975; now U.S. Pat. No. 4,009,672.

BRIEF SUMMARY OF THE INVENTION

The present invention relates generally to sewing machine material preassembly systems and more particularly to a new and improved sewing machine material preassembly system having notable utility in preassembling separate material blanks for an article of clothing in a predetermined superimposed relationship for being sewn.

It is a primary aim of the present invention to provide a new and improved sewing machine material preassembly system for preassembling separate material blanks for an article of clothing in a predetermined superimposed relationship for being sewn.

It is another aim of the present invention to provide a new and improved sewing machine material preassembly system useful with either double-knit or other stretch fabrics or with tightly woven fabrics.

It is a further aim of the present invention to provide a new and improved sewing machine material preassembly system having alternative operational configurations for preassembling two separate material blanks or just one material blank in a predetermined manner for being sewn.

It is another aim of the present invention to provide a new and improved sewing machine material preassembly system for use in a shirt front box hem sewing machine installation for preassembling and sewing a shirt front box hem of the type having two separate pieces of material forming the shirt front and box hem.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figures 1, 3:
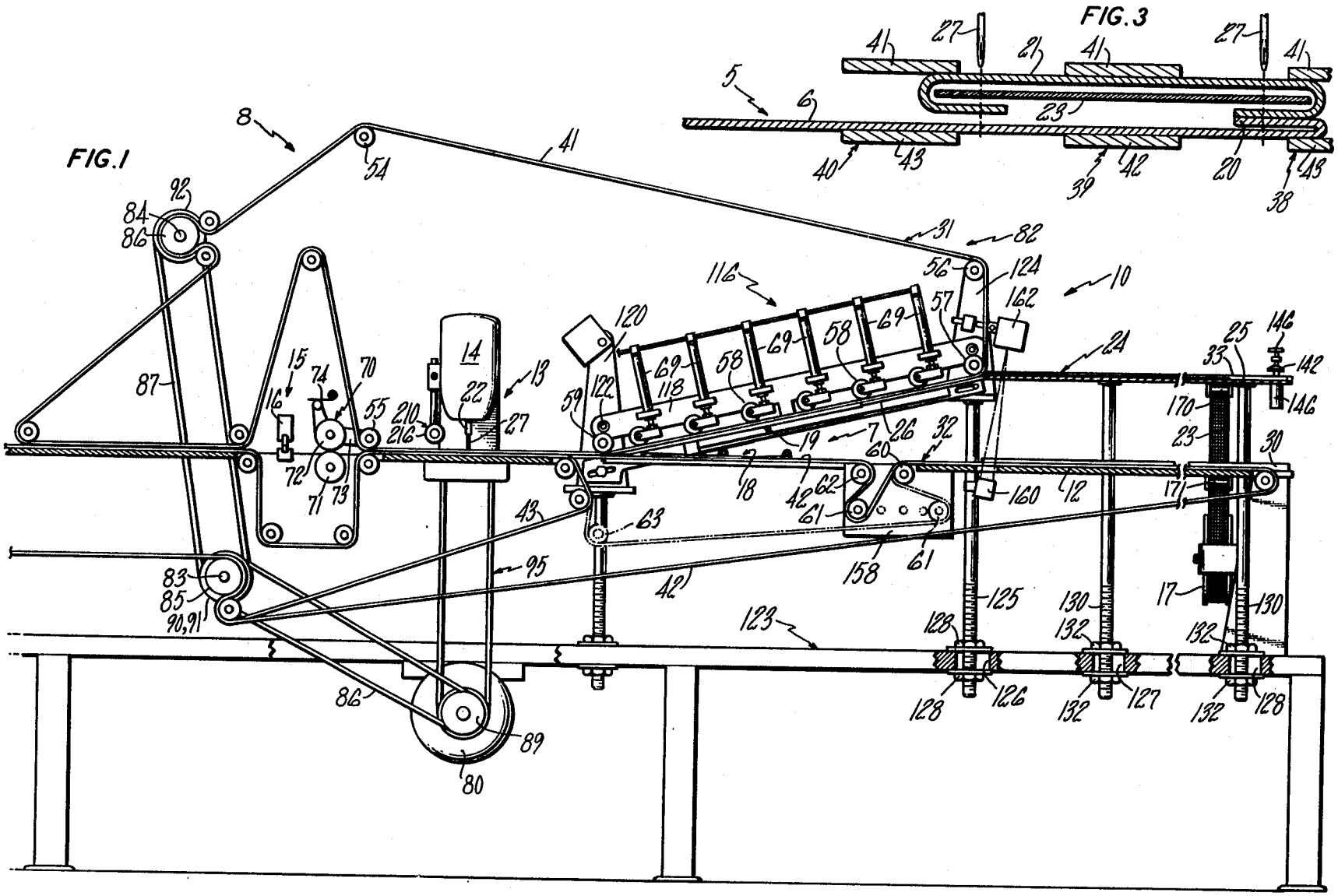
FIG. 1 is a front elevation view, partly broken away and partly in section, of a sewing machine installation for sewing shirt front box hems and incorporating a preferred embodiment of a material preassembly system of the present invention.
FIG. 3 is an enlarged partial transverse section view, partly broken away and partly in section, showing a shirt front box hem configuration of the type produced with the sewing machine installation in its operational configuration shown in FIGS. 1 and 2.
Figure 2:
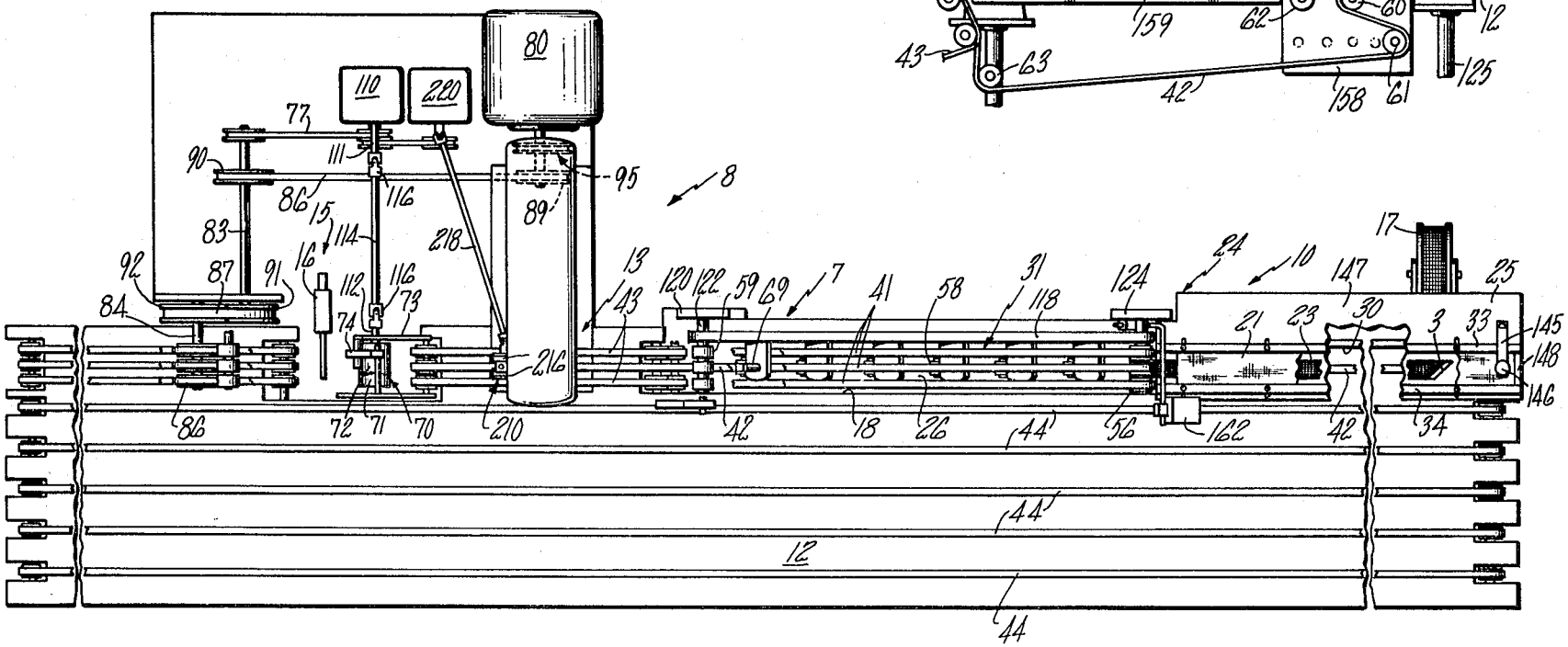
FIG. 2 is a top plan view, partly broken away and partly in section, of the sewing machine installation.

Referring now to the drawings in detail wherein like numerals represent like parts throughout the several figures, and referring in particular to FIGS. 1–3, a sewing machine installation 8 incorporating an embodiment of a material preassembly system 10 of the present invention is shown comprising a main horizontal material support table 12 adapted for supporting material for being conveyed longitudinally forwardly, from right to left as viewed in FIGS. 1 and 2, along the table 12 first through a folding station 7 where the material is prefolded, then through a sewing or stitching station 13 where the prefolded material is sewn or stitched with a sewing machine head 14, and then through a shearing station 15 where the sewn material is sheared with a cutter 16 to remove any excess material from the leading and trailing ends of the sewn material.

In accordance with the present invention, the material preassembly system 10 comprises, in addition to the main material support table 12, a longitudinally extending upper auxiliary material support table 24 with a narrow horizontal elevated entry section 25 above the main table 12 and a forwardly downwardly inclined narrow ramp section 26.

The sewing machine installation 8 is shown in FIGS. 1 and 2 employed for stitching a box front hem or pleat of the type shown in transverse section in FIG. 3 of a man's or woman's shirt front 5. For that purpose, a lower material edge folder 18 suitably removably mounted within an opening 17 in the main table 12, is provided for prefolding a shirt front blank 6 of the shirt front 5, and an upper material edge folder 19 is provided on the ramp 26 for preassembling a separate box front hem blank 21 and a liner 23 of the shirt front 5. More particularly, the lower material edge folder 18 provides for prefolding a lateral edge 20 of a precut shirt front blank 6 upwardly and inwardly into overlying relationship with the body of the shirt front blank 6 as the shirt front blank 6 is fed forwardly along the table 12 and through the folder 18. The upper material edge folder 19 provides for prefolding both lateral edges of a separate precut narrow box hem blank 21 downwardly and inwardly around a liner or stiffener 23 and thereby prefold the box hem blank 21 with the liner 23 as they are fed forwardly down the ramp 26 and through the edge folder 19.

The liner 23 is fed to and along the auxiliary material support table 24 from a roll 17 and via a suitable entry slot 3 in the horizontal table section 25; the shirt front and box hem blanks 6, 21 are manually properly positioned on the main and auxiliary tables 12, 24 respectively, and the blank 6 and the blank 21 and liner 23 are fed through the respective edge folders 18, 19 and then together in proper superimposed association to fully preassemble the shirt front box hem in a predetermined manner for being conveyed through the sewing station 13 and the shearing station 15.

The sewing machine head 14 incorporates a needle bar 22 with a pair of laterally spaced needles 27 (FIG. 3) for stitching both edges of the shirt front box hem. To form a completed shirt front 5, a precut shirt front material blank 6 is manually placed on the main table 12 with its edge in engagement with a locating edge or shoulder 30 of the table 12 as shown in FIG. 1, a separate precut box hem material blank 21 is manually placed on the elevated entry table section 25 intermediate a pair of laterally adjustable guide or locating plates 33, 34, and a treadle operated machine drive motor 80 is energized to feed, with a material feed mechanism 82 hereinafter described, the shirt front blank 6, and the box hem blank 21 and liner 23 together in synchronism with the shirt front blank 6 (a) first longitudinally forwardly through the respective edge folders 18, 19 to prefold the box hem blank 21 with the liner 23 and prefold the shirt front blank 6; (b) then longitudinally forwardly into proper superimposed association to fully preassemble the shirt front 5; (c) then longitudinally forwardly through the sewing station 13 to sew the shirt front box hem along its lateral edges; and (d) then longitudinally forwardly through the shearing station 15 to shear excess material from the leading and trailing edges of the box front hem with a cutter 16.

The cutter 16 employed at the shearing station is preferably of the type described in U.S. Pat. No. 3,763,800 dated Oct. 9, 1973 and entitled "Retractable Sewing Machine Cutting Mechanism" and, as explained in detail in that patent, provides for automatically accurately severing the excess material from the leading and trailing edges of the shirt front box hem.

The sewing machine material feed mechanism 82 provides for feeding the material blanks 6, 21 in synchronism through the respective edge folders 18, 19 and into the desired predetermined superimposed relationship and then through the sewing station 13 and shearing station 15 and forwardly off the exit end of the main table 12 to a suitable stacking station (not shown). The material feed mechanism 82 shown comprises a longitudinally extending belt conveyor system having upper and lower belt conveyors 31, 32 with three laterally spaced pairs 38, 39, 40 of overlying conveyor belts 41 and underlying conveyor belts 42, 43 engageable along a plane slightly above the primary table 12 for longitudinally forwardly advancing the preassemblied shirt front 5 through the sewing and shearing stations 13, 15. The three overlying laterally spaced conveyor belts 41 follow generally the same circuitous path and two underlying conveyor belts 43 follow generally the same circuitous path. The third or middle underlying conveyor belt 42 also extends along the table 12 from the entry end of the table for assisting in feeding each shirt front blank 6 from the entry end of the table 12 and for feeding the inner lateral edge of the shirt front blank 6 through the edge folder 18. The lower belt conveyor 32 also comprises five additional laterally spaced conveyor belts 44 (FIG. 2) which provide for conveying the body of the shirt front blank 6 along the table 12.

Referring to FIG. 3, the three pairs 38–40 of cooperating conveyor belts are respectively positioned between and immediately laterally outwardly of the two laterally spaced sewing machine needles 27 and such that the three pairs 38–40 of conveyor belts do not interfere with the stitching operation of the sewing machine head 14.

A forward portion of the conveyor system forward of the stitching and shearing stations 13, 15 provides for assisting in conveying the material through those stations and forwardly off the exit end of the table 12 for stacking the sewn shirt fronts 5 in a suitable hopper (not shown). Also, if desired, a separate overlying exit belt conveyor (not shown) could be provided for stacking the completed shirt fronts 5 as disclosed and described in U.S. Pat. No. 3,871,312 dated Mar. 18, 1975 and entitled "Sewing Machine Material Feed Mechanism."

The conveyor belts 41–44 are supported on suitable guide rollers 54–62 suitably mounted for rotation about parallel laterally extending axes for guiding the endless conveyor belts 41–44 around their circuitous paths. Also, the overlying belt conveyor 31 has an inclined belt conveyor section 116 with eight guide rollers 57–59, which include six pneumatically operated guide rollers 58 (that engage only the center overlying belt 41 in the shown embodiment but which may be dimensioned to engage all three overlying belts 41 if desired), for selectively biasing the box hem blank 21 into engagement with the liner 23 for assisting in feeding the box hem blank 21 and liner 23 together along the inclined ramp 26 and through the upper folder 19 and into overlying association with the underlying prefolded shirt front 6. More particularly, the pressure rolls 58 are mounted on the piston rods of suitable air cylinders 69 respectively. The air cylinders 69 are of the type having internal compression springs (not shown) for retracting the pressure rolls 58 upwardly from the conveyor belt 41 and are suitably connected in parallel to an air source (not shown) and through a suitable adjustable pressure regulator (not shown) to adjust the pressure roll force on the conveyor belt 41.

As can be seen upon reference to FIG. 1, the circuitous belt paths are provided in part to provide upper and lower belt separation of the pairs 38–40 of cooperating belts 41–43 prior to the shearing station 15. The paths of the overlying and underlying pairs 38–40 of conveyor belts is such that they re-engage forwardly of the shearing station 15 to assist in conveying the completed shirt fronts forwardly along the table 12 from the shearing station.

The upper and lower conveyor belts 41–44 are driven together by the treadle operated motor 80 via parallel drive shafts 83, 84 and knurled drive rolls or wheels 85, 86 fixed onto the shafts 83, 84. The shafts 83, 84 are connected to the motor 80 via drive or timing belts 86, 87 and pulleys 89–92 to be driven at the same angular velocity. The knurled drive wheels 85, 86 mounted on shafts 83, 84 respectively, provide for driving all of the conveyor belts 41–44 together and preferably at substantially the same linear speed.

As seen in FIG. 1, the conveyor belt guide rollers are mounted so that each conveyor belt 41–44 engages a substantial peripheral portion of the respective knurled drive wheel 85, 86. Also, the conveyor belts 41–44 are elastic and are mounted in a slightly stretched condition to firmly engage the knurled drive wheels 85, 86 to eliminate any belt slippage.

The sewing machine head 14 is also connected to the treadle operated motor 80 by a suitable drive belt system 95 and such that the sewing machine head 14 and belt conveyors 31, 32 are simultaneously driven at coordinated speeds.

A drive roll conveyor 70 is shown provided immediately before the shearing station 15 in alignment with the three pairs 38–40 of belt conveyors. The drive roll conveyor 70 comprises an underlying elongated drive roll 71 and an overlying elongated backup roll 72 pivotally mounted by a support bracket 73 and biased downwardly for cooperation with the drive roll 71 by a leaf spring 74. The elongated drive and backup rolls 71, 72 are mounted in alignment with the three pairs 38–40 of belt conveyors to initially engage the liner 23 to assist in feeding the liner along the auxiliary table 24 and horizontal main table 12 and then engage the sewn shirt front 5 to assist in feeding the shirt front 5 forwardly from the sewing station 13 and through the shearing station 15.

Referring to FIG. 2, the underlying drive roll 71 of the roll conveyor 70 is driven by the treadle operated motor 80 via the drive shaft 83, a suitable drive belt system 77 and a transmission 110 having an output shaft 111 parallel to the drive shaft 112 of the drive roll 71 and connected thereto by a shaft 114 and universal joints 116. The transmission 110 is of the type which is infinitely adjustable within a given drive ratio range and such that the peripheral speed of the drive roll 71 can be accurately adjusted with the transmission 110 in accordance with the linear speed of the belt conveyor system.

Figure 4:
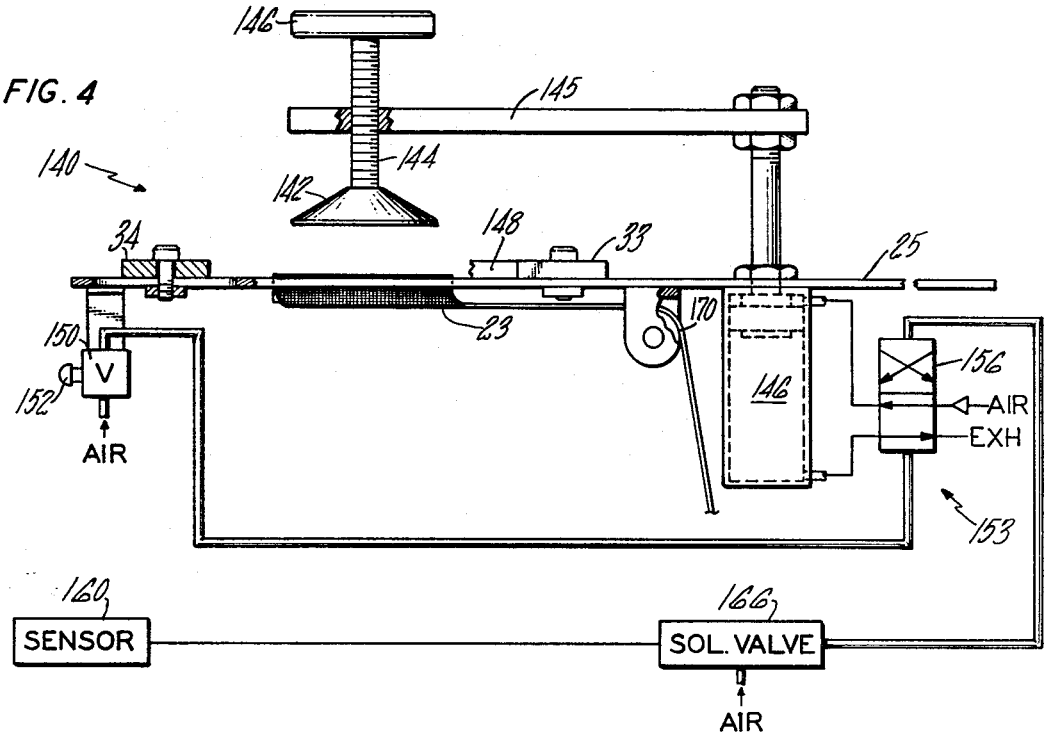
FIG.4 is an enlarged partial elevation end view, partly broken away and partly in section, of the sewing machine installation, additionally schematically showing a control circuit of a material synchronizing system of the material preassembly system.

Referring to FIGS. 2 and 4, a synchronizing system 140 is provided for initially momentarily retaining each box hem blank 21 against being longitudinally forwardly conveyed along the upper auxiliary table section 25 by the underlying liner 23 when the treadle operated motor 80 is energized. In that regard, the box hem blanks 21 are individually manually placed on the table 25 (between the laterally adjustable locating guides 33, 34) directly over the continuous liner 23. The liner tape 23 being adapted to be continuously fed from its support roll 17, is fed longitudinally forwardly by and at the same linear speed as the conveyor belts when the treadle operated motor 80 is energized. Accordingly, the liner 23 provides an underlying conveyor for the box hem blanks 21 for individually conveying the box hem blanks 21 from their initial position. Once the leading edge of each box hem blank 21 engages the three overlying conveyor belts 41, the overlying conveyor belts 41 and the liner 23 cooperate to convey the liner 23 and box hem blank 21 longitudinally forwardly together. If a liner 23 is not employed, as for example where the sewing machine installation 8 is used to preassemble and sew a two piece shirt front box hem not having a liner 23, a suitable additional underlying belt conveyor (not shown) connected to be driven with the belt conveyors 31, 32 is preferably provided for individually conveying the upper box hem blanks 21 along the entry section 25 and, if desired, for assisting in individually conveying the box hem blanks down the ramp 26.

The synchronizing system 140 is provided for timely releasing each box hem blank 21 for being conveyed longitudinally forwardly in synchronism with the shirt front blank 6 and so that they are conveyed together into the desired superimposed association for accurately preassembling the shirt front 5 for being sewn. For that purpose, the cone shaped clamp 142 is provided for clamping the trailing end of a box hem blank 21 against the table 25 at a point rearwardly of the entrance slot 3 of the liner 23. The clamp 142 has a threaded shank 144 threaded into a cantilever support arm 145 for being vertically adjusted with a knob 146 for adjusting the force on the trailing end of the box hem blank 21.

The cantilever support arm 145 is mounted on the end of a vertically extending piston rod of a double acting air cylinder 146. The air cylinder 146 is adapted to be pneumatically actuated downwardly to clamp a box hem blank 21 in position and upwardly to withdraw the clamp 142 and release the box hem blank 21.

At the beginning of each machine operating cycle, the clamp 142 is in its raised position permitting an individual box hem blank 21 to be manually withdrawn from a stack thereof on stacking platform 147 of the table 25, and then manually placed on the table 25 between the guides 33, 34 and over the liner 23. The box hem blank 21 is manually placed on the table 25 with its trailing edge aligned with the rear longitudinal edge of the table 25 or, for example, in engagement with a suitable locating shoulder 148 for properly initially positioning the box hem blank 21 on the table 25. An operator actuated air control valve 150 having a suitable valve handle 152 and secured to the underside of the table 25 is then manually actuated by the machine operator. The air control valve 150 is connected within an air control system 153 to pneumatically shift a suitable two-position shuttle valve 156 for the air cylinder 146 for actuating the cylinder 146 downwardly to clamp the box hem blank 21 in position.

A shirt body blank 6 is then positioned on the lower table 12 in proper position against the table locating shoulder 30 and the operating treadle (not shown) is actuated by the operator for energizing the motor 80 sufficiently to convey the lower shirt front blank 6 longitudinally forwardly a distance slightly greater than the length of the blank 6 and to approximately the folder 18.

A light sensor or cell 160 of the air control system 153 is located beneath the table 12 just laterally outwardly of the table section 25 and at a predetermined longitudinal position forwardly of the initial position of the shirt front blank 6. A suitable light source or lamp 162 is mounted above the table to direct a beam of light onto the sensor 160. The sensor is connected, for example, to a solenoid operated pneumatic control valve 166 as shown schematically in FIG. 4 and so that as the leading edge of a shirt front blank 6 passes over the sensor 160, the sensor 160 operates the solenoid operated valve 166 to pneumatically actuate the shuttle valve 156 and thereby raise the clamp 142. Thereupon, the box hem blank 21 is conveyed longitudinally forwardly initially by the liner 23 and then by the liner and overlying conveyor belts 41. The sensor 160 is located relative to the initial placement of the shirt front and box hem blanks 6, 21 so that the box hem and shirt front blanks 21, 6 meet together at the bottom of the ramp 26, at the convergence of the overlying and underlying convergent paths of the material blanks to preassemble the blanks 6, 21 in the desired superimposed relationship.

As described, the machine motor 80 is preferably only momentarily energized for each shirt front so that the shirt front blanks 6, 21 are initially longitudinally forwardly fed only a sufficient distance to provide table space for manually placing the succeeding blanks 6, 21 on the tables 12, 25 respectively. If desired, a suitable adjustable motor control circuit (not shown) could be provided for establishing an automatic motor operating interval and for thereby automatically establishing a suitable distance interval between successive shirt front and box hem blanks.

Figure 5:
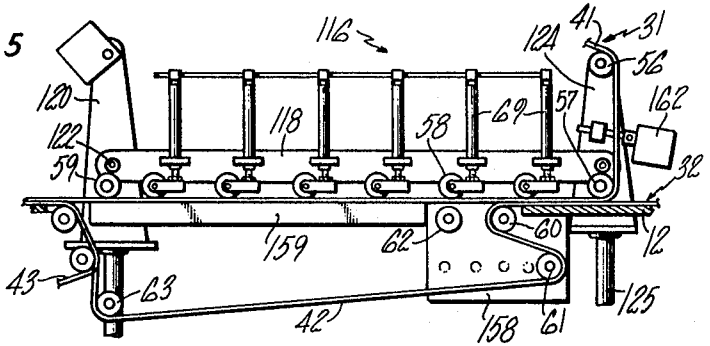
FIG. 5 is a partial front elevation view, partly broken away and partly in section, showing the sewing machine installation in an alternative operational configuration thereof.

The sewing machine installation 8 is shown in an alternative operational configuration in FIG. 5. In this alternative configuration, the ramp 26 including the folder 19 is removed, and the overlying belt conveyor section 116 of the overlying conveyor 31 is lowered into engagement with the underlying belt conveyor 32 for conveying material along the main table 12 for example as described in the aforementioned U.S. Pat. No. 3,871,312. For that purpose, the operating cylinders 69 of the intermediate pressure rolls 58 of the entry belt conveyor section 116 are mounted on a support lever 118 pivotally mounted on a bracket 120 for being pivoted (about a laterally extending axis 122 extending parallel to the axes of the guide rolls 54–62) between its upper inclined operating position shown in FIG. 1 and its lower generally horizontal operating position shown in FIG. 5. Also, the upper conveyor belt guide rolls 56, 57 of the belt conveyor section 116 are mounted in vertically spaced relationship on a bracket 124 which is vertically and longitudinally adjustable on a main frame 123 of the sewing machine installation. For that purpose, the bracket 124 has a depending mounting screw 125 adapted to be longitudinally and vertically positioned within a longitudinally extending slot 126 in the main frame 123 with a pair of opposed threaded locking nuts 128. Also, the pressure roll mounting lever 118 is pivotally connected to the bracket 124 and whereby the axial spacing of the two end guide rolls 57, 59 of the adjustable belt conveyor section 116 is the same in its upper and lower operating positions. Although, in the shown embodiment, the axial spacing of the guide rolls 54, 56 is slightly greater in the lower operating position of the belt conveyor section 116, such is accommodated by the elasticity of the overlying conveyor belts 41.

To auxiliary table section 25 is also mounted within locating slots 127, 128 of the main frame 123 with mounting screws 130 and threaded locking nuts 132. The auxiliary table section 25 is thereby longitudinally and vertically adjustable to properly longitudinally and vertically position it relative to the ramp 26 in the operational configuration of the sewing machine installation shown in FIGS. 1 and 2.

In its alternative operational configuration shown in FIG. 5, the table section 25 may be removed or merely retained in position clear of the table 12 and the conveyors 31, 32. Also, if a liner 23 is employed in the operational configuration of FIG. 5, the liner tape 23 is threaded from the roll 17 through a suitable entry slot in the main table 12. The auxiliary table section 25 and the main table 12 have similar aligned guide rolls 170, 171 (FIG. 1) for guiding the liner tape 23 from the roll 17 to either table as required by the operational configuration of the sewing machine installation 8 and the material product being sewn.

Figure 6:
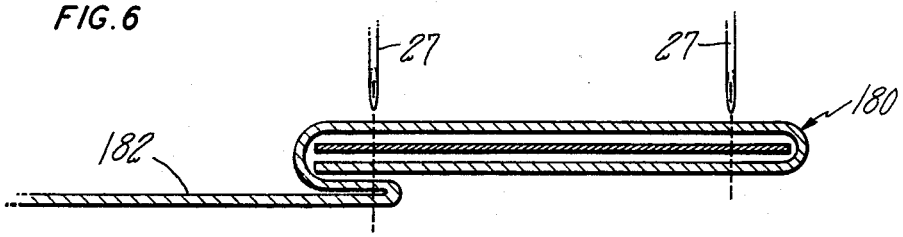
FIG. 6 is an enlarged partial transverse section view, partly broken away and partly in section, showing a shirt front box hem configuration of the type produced with the sewing machine installation in its operational configuration shown in FIG. 5.

With the sewing machine installation 8 in its alternative configuration shown in FIG. 5, the folder 18 for the shirt front box hem 5 described would be replaced by an alternative folder suitable for the prefolding step desired. For example, the sewing machine installation 8 in its operational configuration shown in FIG. 5 could be employed for sewing a one piece shirt front box hem 180 of the type shown in FIG. 6, in which event, a suitable folder 159 could be installed within the table opening 17 for suitably prefolding a one piece shirt front blank 182. Also, the center underlying conveyor belt 42 is partly rethreaded as shown in broken lines in FIG. 1 and shown in full lines in FIG. 5 to clear the folder 159. For that purpose, the guide roll 61 is relocated on a support plate 158 rearwardly of its position shown in full lines in FIG. 1 and the conveyor belt 42 is mounted about the relocated roll 61 and the roll 63 to completely clear the folder 159 and maintain substantially the same length belt path.

A conventional thread tensioner 210 may be used to maintain thread tension when a liner 23, which otherwise provides for maintaining thread tension, is not employed. The thread tensioner 210 in a conventional manner comprises a pair of knurled drive rolls 216 just forward of the needles 27 and engageable with the thread. Each of the knurled rolls 216 preferably has a width approximately equal to the respective lateral opening between the cooperating pairs 38–40 of conveyor belts but slightly less than that lateral opening to avoid interference with those conveyor belts.

The knurled rolls 216 have a drive shaft 218 which is driven by the treadle operated motor 80 in a manner similar to that described with respect to the drive roll 71 and such that the peripheral speed of the knurled thread tensioning rolls 216 can be accurately adjusted with a respective drive transmission 220 in accordance with the linear speed of the belt conveyors.

Figure 7:
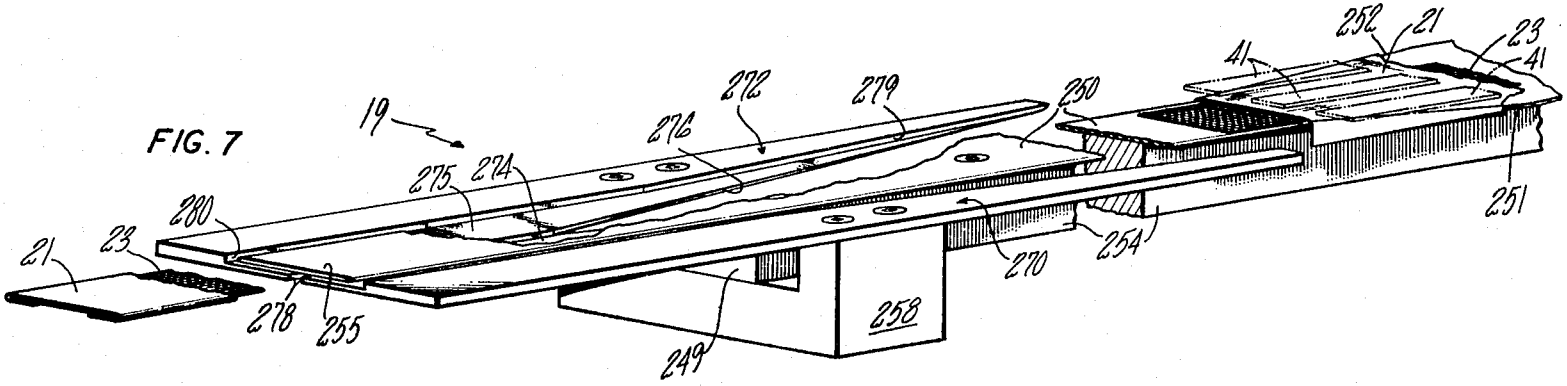
FIGS. 7 and 8 are enlarged partial perspective views, partly broken away and partly in section, showing upper and lower material folders respectively of the sewing machine installation in its operational configuration shown in FIG. 1.

Referring to FIG. 7, the upper folder 19 has an elongated flat narrow guide plate 250 of thin gauge sheet metal. The guide plate 250 is removably mounted on a longitudinally extending center support rail 254 of the ramp 26 and extends longitudinally forwardly from the forward end 249 of the center rail 254 to the lower or exit end of the ramp 26. The guide plate 250 has symmetrical forwardly laterally inwardly tapering lateral edges 251, 252 to accommodate folding each lateral edge of each box hem material blank 21 downwardly and inwardly about the guide plate 250 and therefore downwardly and laterally inwardly about the liner 23 lying between the guide plate 250 and box hem material blank 21. The liner 23 is conveyed longitudinally forwardly along the flat upper face of the guide plate 250 and the overlying box hem blank 21 is held pressed against the liner 23 and is conveyed therewith along the guide plate 250 by the three overlying conveyor belts 41 (shown in part in broken lines in FIG. 7).

As the liner 23 and overlying box hem material blank 21 are conveyed longitudinally forwardly together down the flat guide plate 250, an increasing portion of each lateral edge of the box hem material blank 21 depends from each tapering edge 251, 252 of the sheet metal guide plate 250. And, the width of the longitudinally forwardly projecting exit end 255 of the guide plate 250 determines the width of the preassembled box hem blank 21 and liner 23 as they emerge from the folder 19 and are conveyed into overlying association with the underlying prefolded shirt front 6 being conveyed along the main table 12. Accordingly, the sheet metal plate 250 is selected in accordance with the desired box hem width and is replaced by another guide plate having suitable dimensions when the box hem width is changed.

A pair of symmetrical, laterally spaced material edge guides 270, 272 are suitably mounted on a U-shaped frame 258 secured to the rail 254 so that they can be accurately laterally positioned relative to the central guide plate 250. The material edge guides 270, 272 have upper flat faces coplanar with the upper face of the guide plate 250 and lower opposed laterally inwardly extending coplanar lips or flanges 274, 275 respectively. Each flange 274, 275 has a relatively steeply tapered entry end 276 for initially guiding the corresponding depending box hem material edge inwardly between the edge guide and the guide plate 250 and then folding it inwardly under the corresponding tapered lateral edge of the guide plate 250. Also, each flange 274, 275 has an exit end 278 with a gradual taper closely underlying the exit end of the center guide plate 250 to position and hold the corresponding lower folded edge of the box hem material blank 21 against the underside of the center guide plate 250. Also, the upper face of each lateral guide 270, 272 is similarly shaped to form a relatively steeply tapered entry guide edge 279 and a relatively gradually tapered exit guide edge 280 for ensuring that the box hem material is folded relatively tautly about the lateral edges of the center guide plate 250. Accordingly, each box hem material blank 21 is fully preassembled with the underlying liner 23 as they emerge from the lower or exit end of the folder 19.

Figure 8:
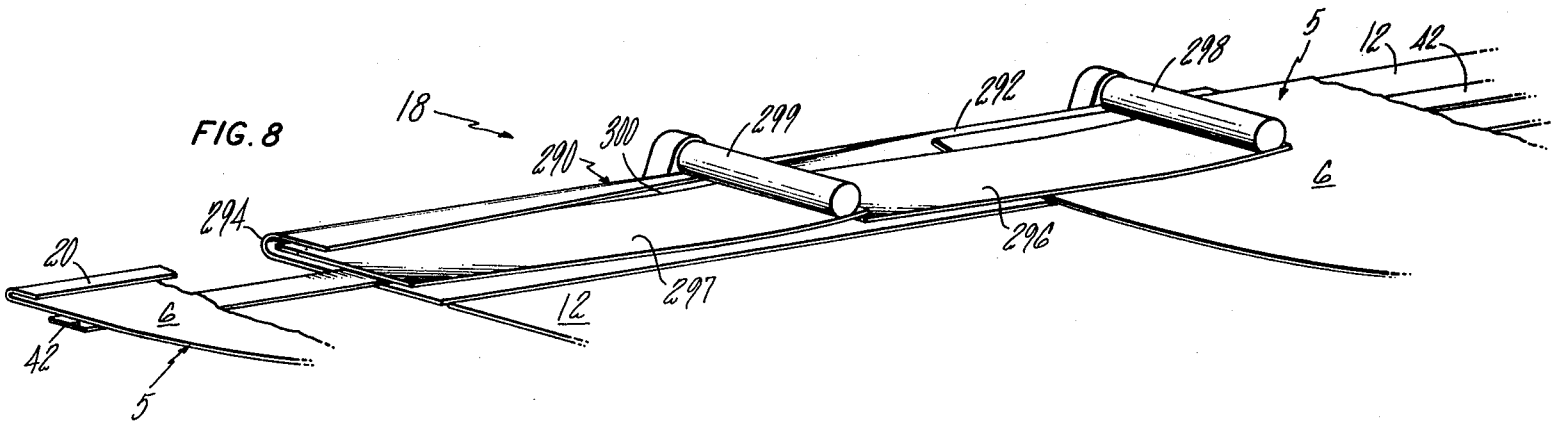

Referring to FIG. 8, the lower folder 18 has a sheet metal material guide 290 with a flat material support face 292 coplanar with the table 12 and such that the underlying conveyor belt 42 passes along the support face 292 for conveying the shirt front material blanks 6 along the guide 290. The material guide 290 has an outer upwardly and inwardly curled material folding edge 294 longitudinally tapering laterally inwardly for curling or folding an increasing portion of the lateral edge of the shirt front material blank 6 upwardly and inwardly to overlie the remaining body of the shirt front material blank as it is conveyed longitudinally forwardly along the guide 290. A pair of elongated, aligned cantilever supported leaf springs 296, 297 are mounted on laterally extending fixed ports 298, 299 respectively of the folder 18 superimposed over the underlying conveyor belt 42 and to engage the upper surface of the body of each shirt front material blank 6 and thereby lightly press the shirt front material into engagement with the underlying conveyor belt 42. The pair of leaf springs 296, 297 thereby ensure that the material is conveyed along the material guide 290 without slippage or skewing of the material. In addition, the outer lateral edge of the forward longitudinally extending leaf spring 297 provides an internal floating guide edge 300 within the forward end of the curled folding edge 294 for folding the outer edge of the shirt front material blank 6 upwardly and inwardly about the floating edge 300.

Accordingly, the shirt front material blank 6 is completely prefolded with an upwardly inturned lateral edge as it emerges from the folder 18 into predetermined underlying association with the preassembled box hem material blank 21 and liner 23 emerging from the folder 19. The shirt front box hem is thereby completely preassembled with the upper and lower components in the desired superimposed association at the convergence of the descending path of the preassembled box hem with the horizontal path of the prefolded shirt front.

As will be apparent to persons skilled in the art, various modifications, adaptations and variations of the foregoing specific disclosure can be made without departing from the teachings of the present invention.

We claim:

1. A sewing machine system having material conveyance means for forwardly conveying first material blanks, each having a longitudinally extending outer lateral edge, individually in succession along a first longitudinally extending horizontal path and through a sewing station, and for forwardly conveying second longitudinally extending narrow material blanks individually in succession along a second longitudinally extending path, overlying said first horizontal path and converging therewith, and into overlying superimposed association with the first material blanks respectively at the convergence of the paths as the first material blanks are longitudinally forwardly conveyed individually along the first path to form material preassemblies thereof prior to the sewing station, a second material blank folding device mounted along the second overlying path for prefolding both lateral edges of the second narrow material blank as it is conveyed longitudinally forwardly along the second path to the convergence of the material paths to form said material preassemblies with the second material blanks prefolded, the second material blank folding device comprising a central longitudinally extending base plate for supporting the narrow material blank and having longitudinally forwardly extending and laterally tapering lateral edges for providing increasing depending lateral edge portions of the narrow material blank as it is conveyed longitudinally forwardly along the base plate, and a longitudinally extending edge guide along and under each lateral edge of the base plate and spaced therefrom for laterally folding the respective depending edge portions inwardly to underlie the base plate as the second material blank is conveyed longitudinally forwardly therealong, the material conveyance means being operable for longitudinally forwardly conveying the material preassemblies individually along the first horizontal path through the sewing station, and sewing apparatus at the sewing station for sewing the material preassemblies as they are longitudinally forwardly conveyed through the sewing station by the conveyance means.

2. A sewing machine system according to claim 1 further comprising a first material blank folding device mounted along the first path for prefolding the longitudinally extending lateral edge of the first material blank as it is conveyed longitudinally forwardly along the first path to the convergence of the material paths, the first material blank folding device comprising a base for supporting an outer lateral edge section of the first material blank as it is conveyed longitudinally forwardly through the first material blank folding device, a longitudinally forwardly extending and laterally inwardly tapering edge folder for folding the outer lateral edge of the material blank upwardly and laterally inwardly relative to the base as the material blank is conveyed longitudinally forwardly through the folding device, and a longitudinally extending forwardly cantilevered guide member overlying the base and having a lateral edge extending longitudinally in predetermined spaced relationship along the edge folder to provide a fold edge for folding thereabout the lateral edge of the material blank upwardly and laterally inwardly relative to the base with the edge folder.

3. An edge folding device for use in a sewing machine installation having a belt conveyor with conveyor belts for conveying elongated narrow material blanks through the folding device, for automatically prefolding both lateral edges of an elongated narrow material blank and supporting the material blank and conveyor belts as the material blank is conveyed longitudinally forwardly through the edge folding device with the belt conveyors, comprising a central longitudinally extending flat base plate with an upper flat face for supporting the narrow material blank and having longitudinally forwardly extending and laterally tapering lateral edges for providing increasing depending lateral edge portions of the narrow material blank as it is conveyed longitudinally forwardly along the base plate, and longitudinally extending edge guide plates along and under the lateral edges of the base plate and spaced therefrom for laterally folding the respective depending edge portions inwardly to underlie the base plate as the material blank is conveyed longitudinally forwardly therealong by the conveyor belts, each guide plate comprising a laterally outer plate portion with an upper flat face generally coplanar with the upper flat face of the flat base plate and a laterally inner flat plate portion extending longitudinally under the respective lateral edge of the base plate and spaced therefrom for laterally folding the respective depending edge portion of the material blank to underlie the base plate as the material blank is conveyed longitudinally forwardly through the folding device by the conveyor belts.

4. An edge folding device for use in a sewing machine installation having a belt conveyor with conveyor belts for conveying elongated narrow material blanks through the folding device, for prefolding both lateral edges of an elongated narrow material blank and supporting the material blank and conveyor belts as the material blank is conveyed longitudinally forwardly through the edge folding device with the conveyor belts, comprising a central longitudinally extending flat base plate with an upper flat face for supporting the narrow material blank and having longitudinally forwardly extending lateral edges contoured to provide increasing depending lateral edge portions of the narrow material blank as it is conveyed longitudinally forwardly along the base plate, and longitudinally extending edge guide plates along and under the lateral edges of the base plate and spaced therefrom for laterally folding the respective depending edge portions inwardly to underlie the base plate as the material blank is conveyed longitudinally forwardly therealong, each guide plate comprising a laterally outer plate portion with an upper flat face generally coplanar with the upper flat face of the flat base plate and a laterally inner flat plate portion extending longitudinally under the respective lateral edge of the base plate and spaced therefrom for laterally folding the respective depending edge portion of the material blank to underlie the base plate as the material blank is conveyed longitudinally forwardly through the folding device by the conveyor belts.

5. An edge folding device according to claim 4 wherein each said inner flat plate portion comprises a longitudinally forwardly extending lip laterally tapering inwardly beneath the base plate for laterally folding the respective depending edge portion inwardly to underlie the base plate as the material blank is conveyed longitudinally forwardly through the folding device by the conveyor belts.

6. In a sewing machine system having material conveyance means for conveying material longitudinally forwardly through successive material folding and sewing stations for successively prefolding and sewing the material respectively, and material folding and sewing apparatus at the folding and sewing stations for respectively prefolding the material and sewing the prefolded material as the material is conveyed longitudinally forwardly through the folding and sewing stations by the material conveyance means, the improvement wherein the material conveyance means is operable for simultaneously longitudinally forwardly conveying a first material blank having a longitudinally extending outer lateral edge and a separate second longitudinally extending narrow material blank along first and second underlying and overlying convergent material paths respectively and into predetermined superimposed relationship at the convergence thereof to form individual material preassemblies of first and second material blanks, wherein the material folding apparatus comprises a first material folding device mounted along the first material path for prefolding the first material blank as it is longitudinally forwardly conveyed therealong to the convergence of the material paths for forming said material preassemblies with the first material blanks prefolded, the first material folding device being operable for automatically prefolding the longitudinally extending outer lateral edge of the first material blank as it is conveyed longitudinally forwardly through the first folding device by the material conveyance means and comprising a base for supporting an outer lateral edge section of the first material blank as it is conveyed longitudinally forwardly therethrough, a longitudinally forwardly extending and laterally inwardly tapering edge folder for folding the outer lateral edge of the material blank upwardly and laterally inwardly relative to the base as the material blank is conveyed longitudinally forwardly through the first folding device, and a longitudinally extending forwardly cantilevered guide member overlying the base and having a lateral edge extending longitudinally in predetermined spaced relationship along the edge folder to provide a fold edge for folding thereabout the outer lateral edge of the first material blank upwardly and laterally inwardly relative to the base with the edge folder, wherein the material conveyance means is further operable for longitudinally forwardly conveying the prefolded material preassemblies individually from the convergence of the material paths through the sewing station for being sewn by the material sewing apparatus, wherein the material folding apparatus further comprises a second material folding device mounted along the second material path for prefolding the second material blank as it is longitudinally forwardly conveyed therealong toward the convergence of the material paths for forming said material preassemblies with the second material blanks prefolded, the second material folding device being operable for automatically prefolding both lateral edges of the second longitudinally extending narrow material blank as the material blank is conveyed longitudinally forwardly through the second folding device and comprising a central longitudinally extending base plate for supporting the second narrow material blank and having longitudinally forwardly extending and laterally tapering lateral edges for providing increasing depending lateral edge portions of the narrow material blank as it is conveyed longitudinally forwardly along the base plate, and a longitudinally extending edge guide along and under each lateral edge of the base plate and spaced therefrom for laterally folding the respective depending lateral edge portion inwardly to underlie the base plate as the material blank is conveyed longitudinally forwardly therealong.

* * * * *